US005252170A

United States Patent [19]

Schaupp

[11] Patent Number: 5,252,170

[45] Date of Patent: Oct. 12, 1993

[54] WEB SPLICING APPARATUS

[75] Inventor: Richard Schaupp, Modesto, Calif.

[73] Assignee: Shibuya International, Inc., Modesto, Calif.

[21] Appl. No.: 728,290

[22] Filed: Jul. 11, 1991

[51] Int. Cl.[5] ..... B65H 21/00

[52] U.S. Cl. ..... 156/350; 156/353; 156/504; 156/306; 242/58.1

[58] Field of Search ..... 156/157, 350, 351, 502, 156/504–506, 509, 353; 242/58.1

[56] References Cited

U.S. PATENT DOCUMENTS

| | | | |
|---|---|---|---|
| 2,766,811 | 10/1956 | Armelin et al. | 154/42.3 |
| 3,252,671 | 5/1966 | Phillips, Jr. et al. | 242/58.1 |
| 3,278,131 | 10/1966 | Niepmann | 242/58.1 |
| 3,298,890 | 1/1967 | Hellemans | 156/504 |
| 3,306,801 | 2/1967 | Giles | 156/353 |
| 3,440,126 | 4/1969 | Bartholomay et al. | 156/505 |
| 3,841,944 | 10/1974 | Harris, Jr. | 156/504 |
| 3,858,819 | 1/1975 | Butler, Jr. | 242/58.3 |
| 3,873,393 | 3/1975 | Bruck et al. | 242/58.1 X |
| 3,880,698 | 4/1975 | Kawazura et al. | 156/504 |
| 3,886,031 | 5/1975 | Taitel | 156/504 |
| 3,891,158 | 6/1975 | Shearon et al. | 242/58.1 |
| 3,904,142 | 9/1975 | Corse | 242/58.3 |
| 3,918,655 | 11/1975 | Hillner et al. | 242/58.1 |
| 3,920,502 | 11/1975 | Tokuno | 156/504 |
| 4,010,911 | 3/1977 | Heitmann | 242/58.4 |
| 4,065,067 | 12/1977 | Martinez | 242/58.1 |
| 4,170,506 | 10/1979 | Marschke | 156/159 |
| 4,172,755 | 10/1979 | Gustafson et al. | 156/502 X |
| 4,190,475 | 2/1980 | Marschke | 156/502 X |
| 4,443,291 | 4/1984 | Reed | 156/504 |
| 4,460,430 | 7/1984 | Kissell et al. | 156/504 |
| 4,492,609 | 1/1985 | Blom | 156/502 X |
| 4,705,226 | 11/1987 | Goetz | 242/56 |
| 4,738,739 | 4/1988 | Schoonderbeek | 156/502 X |
| 5,033,688 | 7/1991 | Georgitsis et al. | 242/58.1 |
| 5,045,134 | 9/1991 | Schenker et al. | 156/502 X |

*Primary Examiner*—Robert Spitzer
*Attorney, Agent, or Firm*—McCubbrey, Bartels, Meyer & Ward

[57] ABSTRACT

Apparatus for splicing the leading portion of web material from a fresh supply roll to the trailing portion of web material from an expiring supply roll to a take-up system comprising a pair of guiderollers normally positioned apart from each other, apparatus for gripping the leading portion of the fresh web so that the leading portion can be held in contact with one of the guiderollers, apparatus for pressing the two guiderollers together so that the leading portion of web material from the first supply roll can be joined by an adhesive to the trailing portion of the web material moving from the expiring supply roll, apparatus for cutting the web material moving from the expiring supplying roll moveable between alternate cutting positions downstream from the guiderollers and apparatus mechanically linked to, operative to actuate the respective functions of, the apparatus for gripping the leading portion of the fresh web, apparatus for pressing the guiderollers together and the apparatus for cutting the web material from the expiring supply roll in a predetermined sequence.

23 Claims, 8 Drawing Sheets

WEB SPLICING APPARATUS

FIELD OF THE INVENTION

This invention relates to apparatus for splicing web material (web splicers), and more particularly, to apparatus which splices the leading portion of web material from a fresh supply roll to the trailing portion of web material being drawn from an expiring supply roll.

BACKGROUND OF THE INVENTION

Web splicers are conventionally used to supply a continuous web of material, such as paper, plastic, woven materials and the like to a parent machine which demands an uninterrupted supply of material. Typically, a continuous and steady supply is needed to increase efficiency and reliability and to eliminate costly down time of the parent machine. It is known that web splicers are used in a variety of applications such as newspaper printing (where printing quality depends on a constant feed of paper at a constant linear speed), corrugated cardboard construction, container labeling, and in a variety of industries where high precision is demanded, where down time is costly or where web materials are used.

By way of example, where the parent machine is a container labeling system, a long web of material with container labels printed thereon in series is fed from the web splicer apparatus to the takeup system of the parent container labeling machine. The web is typically fed to a vacuum drum within the labeling machine where the web is severed into individual labels while on, or being delivered to, the vacuum drum. Thereafter, an adhesive material is applied to the labels and the labels are applied to containers, such as bottles or cans.

In conventional splicers the web material from a first expiring (or running) supply roll of web material is fed through a guidance mechanism, past a splicer unit, and through a festoon. The festoon typically contains a series of rollers through which the web is fed forming a sinusoidal path and is designed to collapse in order to dissipate the effects of an increase in tension upon the web. The festoon includes a moveable carriage, comprised of a plurality of spaced rollers, biased against the web tension so that a specified length of web material will be contained within the festoon at any given time. A second (or fresh) supply roll of web material is fed through a second series of guide rollers and held so that the leading portion is in close proximity to the running web. When the first expiring supply roll of the running web is near depletion, a splice can be made which affixes the leading portion of web material from the second source of supply to the web material of the running web. Typically, the two webs are affixed using double-face tape, that is, tape with contact adhesive on both sides. Thereafter, the remaining portion of the first supply web is severed so that web material from only the fresh source of supply will be fed to the takeup system of the parent container labeling machine.

In order to accomplish high speed splices, conventional splicers utilize a festoon system on the expiring web. When the splice is to be made, the festoon system collapses to provide a reservoir of material in the expiring web. The trailing portion of the reservoir material can be grasped and held at, or near, zero speed while the splice is completed. The remainder of the reservoir material can then be used to allow for controlled acceleration of the fresh supply roll. Alternatively, the expiring roll of material may be subjected to a braking action to slow down the speed of the running web. As the takeup system of the parent machine maintains a constant pulling force, the web material stored in the festoon is consumed. When the splice has been completed the festoon allows for controlled acceleration of the fresh supply roll of web material to operational speeds. Therefore, through utilization of the festoon system, conventional splicers are able to splice the slow moving or completely stopped running web without altering the linear speed at which the web material is fed to the parent machine.

When utilizing the festoon system, conventional splicers are able to decrease the linear speed of the expiring web in the vicinity of the splicer unit so that an accurate splice may be accomplished. When web splices are made at lower speeds, conventional splicers are able to splice the two webs with accurate registration. Typically, the leading portion of the second supply roll is joined together with the slow moving or stopped web of the first supply roll. The strength of the splice is sufficient to resist the sudden tension required to accelerate the new roll of material up to the existing linear speed of the expiring web.

Conventional splicers utilize various methods to aid in the acceleration of the fresh web. In particular, it is known that the web material may be "pulled" by the takeup system of the parent machine through the use of a set of driven pinch rollers which grasp the web from the top and the bottom of the sheet and through rotation pull the web up to operational speed. Similarly, many splicers "push" the fresh source of supply to speed by driving the fresh roll of web material itself. The driving is typically accomplished by an external motor which induces an acceleration on the roll of web material that is transmitted to the leading portion of the fresh web. Similarly, many known splicers utilize a combination of aids to accelerate the fresh supply roll up to operational speeds.

Prior art splicers are not capable of splicing web material with accurate registration when the running web is moving above a certain speed in the vicinity of the splicer unit. It is for this reason that conventional splicers utilize the above described festoon system. Accurate registration requires the splicer unit to press the leading portion of the web material from the fresh supply roll onto the running web at precisely the correct moment. Known splicers, however, are not able to press the rolls together quickly enough or at precisely the correct moment to insure accurate registration at high web speeds.

In general, known splicers are not able to perform accurate high speed splices because of the complex nature of the splicers themselves. Known splicers generally utilize a series of switches and relays to activate the cutting and pressing steps of the splicing operation. The cutting and pressing steps require separate motions and are found to be independent from each other in many prior art splicers thereby requiring complex relay and timing systems. Typically, the high number of subsystems and/or parts needed to accomplish these tasks in known splicers prevents accurate timing and therefore causes known splicers to provide inaccurate registration during high speed splicing.

The present invention is designed and intended to provide a solution to the above noted problems. It is therefore a broad object of the invention to provide an improved web splicing apparatus which is capable of splicing web material, moving at relatively high linear velocities, with accurate registration.

It is further an object of the present invention to provide accurate splicing of web material at relatively high speeds without utilizing a festoon or comparable system.

It is further an object of the present invention to provide accurate splicing in an apparatus that does not require a source of power, other than the pull of the takeup system of the parent machine itself, to feed a continuous web of material at a nearly constant linear speed to the parent machine.

Finally, it is an object of the present invention to provide an improved web splicing apparatus which is capable of providing accurate registration during web splicing by reducing the number of independently moving parts while insuring that the cutting and pressing steps involved in web splicing are mechanically dependent upon each other so that each web splice can occur at near instantaneous speeds.

SUMMARY OF THE INVENTION

The present invention relates to apparatus for splicing web material and is specifically directed toward a web splicer for splicing the leading portion of web material from a fresh supply roll to the trailing portion of web material moving from an expiring supply roll to a takeup system. The present invention comprises a pair of guide rollers normally positioned apart from each other, a means for gripping the leading portion of the fresh web so that the leading portion can be held in contact with one of the guide rollers, a means for pressing the two guide rollers together so that the leading portion of web material from the fresh supply roll can be joined by an adhesive means to the trailing portion of the web material moving from the expiring supply roll, a means for cutting the web material moving from the expiring supply roll moveable between alternate cutting positions upstream from the guide rollers and means mechanically linked to, operative to actuate the respective functions of, the means for griping the leading portion of the fresh web, the means for pressing the guide rollers together and the means for cutting the web material from the expiring supply roll, in a predetermined sequence.

BRIEF DESCRIPTION OF THE DRAWINGS

FIG. 4(*a*) shows the positional relationships of the aforementioned components of the present invention in a neutral position where the cutter assembly and the swing arm assembly are positioned as depicted in FIG. 2;

FIG. 4(*b*) shows the positional relationships of the aforementioned components of the present invention in the left hand cut-standby position where the cutter assembly is predisposed to severe the web of the left hand path;

FIG. 4(*c*) shows the positional relationships of the aforementioned components of the present invention as the cutter assembly severs the web running in the left hand web path and the two guide rollers are pressed together as depicted in FIG. 1;

DETAILED DESCRIPTION OF THE DRAWINGS

Figure 1:
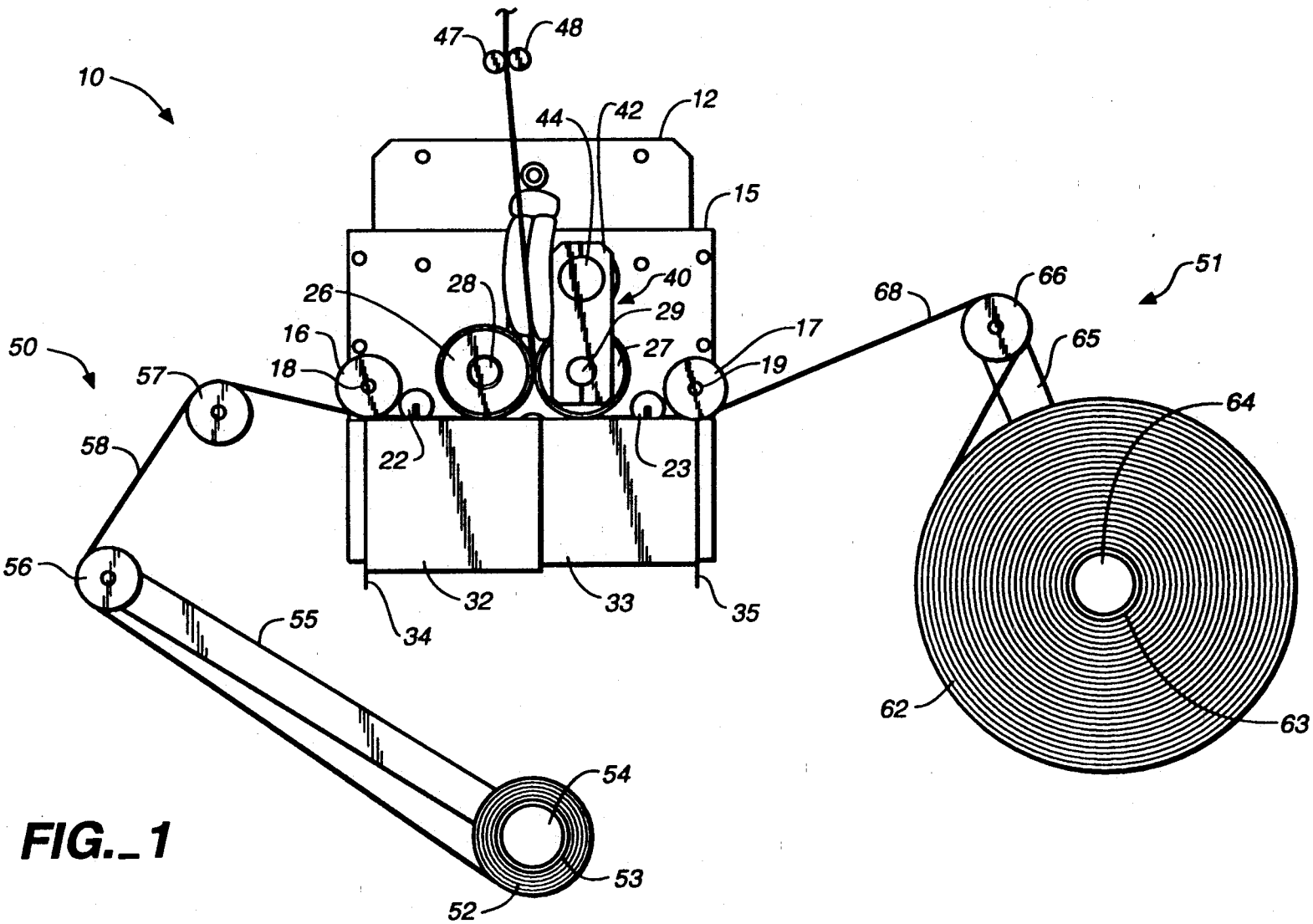
FIG. 1 is a schematic top view of an apparatus constructed in accordance with the present invention showing guard doors and showing the apparatus as it interacts with extraneous apparatus not included within the present invention.

The preferred embodiment of the present invention will now be described with references to FIGS. 1-12. An alternate embodiment of the present invention in which the guard doors, described hereinbelow, are removed from the preferred embodiment, is also discussed with reference to FIGS. 1-12. Identical elements in the various figures are designated with the same reference numerals.

Referring now to the drawings, and particularly to FIG. 1, thereof, there is shown a web splicer 10 which comprises a support frame 12, a mounting plate 15 bolted to support frame 12, a pair of feed rollers 16 and 17 mounted for rotational movement about roller shafts 18 and 19, respectively, back-up supports 22 and 23, a first guide roller 26 mounted for counter-clockwise rotational movement about shaft 28, a second guide roller 27 mounted for clockwise rotational movement about shaft 29 and guard doors 32 and 33 having handles 34 and 35, respectively, mounted for sliding movement. Guard doors 32 and 33 are provided within the preferred embodiment as a functional as well as a safety feature. However, an alternate embodiment in which guard doors 32 and 33 are removed from the preferred embodiment is within the spirit and scope of the present invention.

Figure 2:
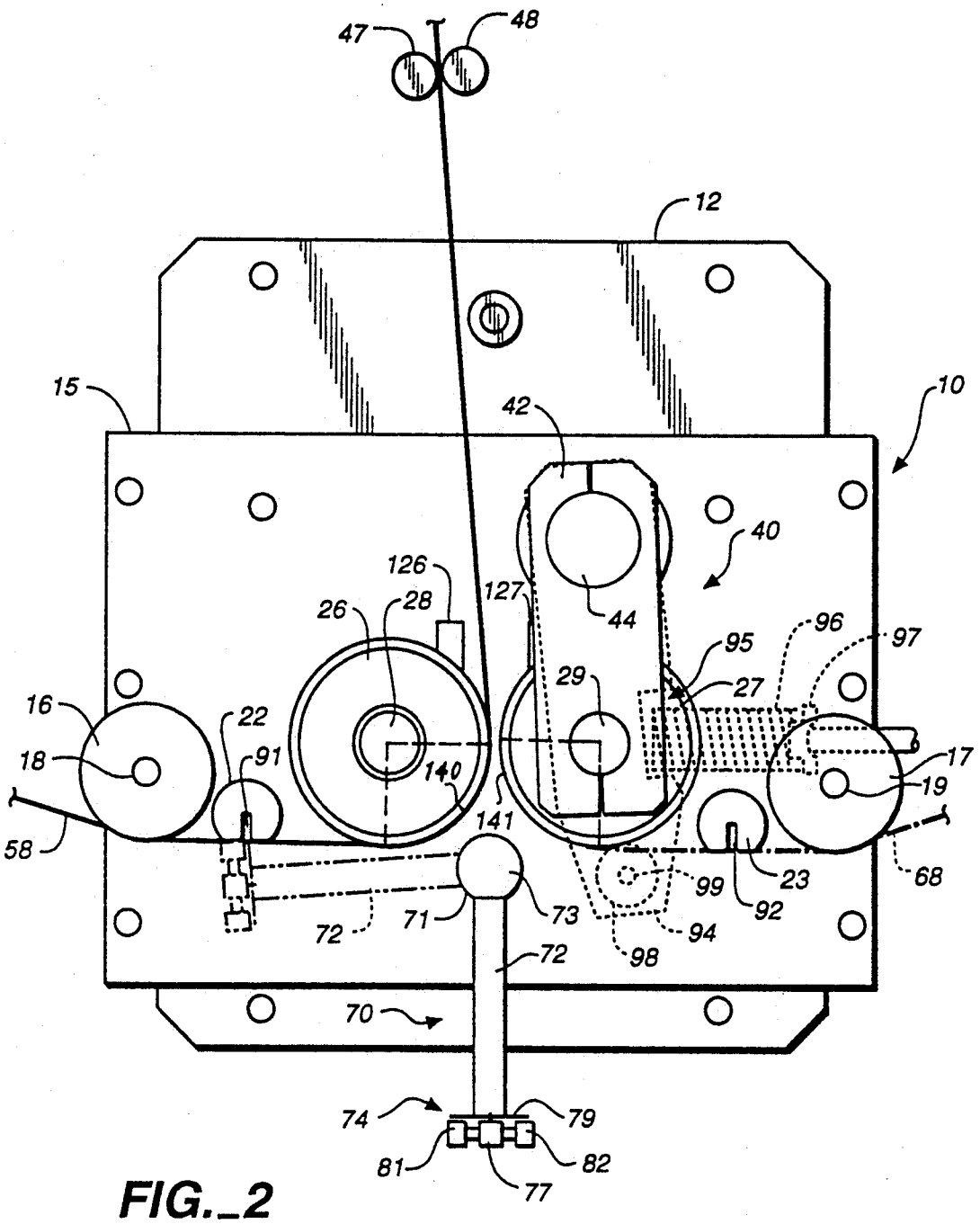
FIG. 2 is an enlarged detailed top view of the present invention where the guard doors shown in FIG. 1 have been removed and where the guide rollers shown pressed together in FIG. 1 have been separated.

In reference to FIGS. 1 and 2, shaft 29 is carried by swing arm assembly 40 comprising top plate 42 and bottom plate 43 (not shown in FIGS. 1 and 2). Plates 42 and 43 are mounted on a rotatably mounted pivot shaft 44 so that clockwise rotation of pivot shaft 44 will cause roller 27 to come into contact with roller 26 (as depicted in FIG. 1) and counterclockwise rotation of pivot shaft 44 will cause roller 27 to move away from roller 26 (as depicted in FIG. 2). Rollers 26 and 27 are normally positioned in close proximity to each other as shown in FIG. 2.

Web splicer 10 of the present invention is adapted for use with any suitable type of parent machine or takeup system (not shown except for pinch rollers 47 and 48) designed to handle web material. Similarly, the present invention is adapted for use with any suitable type of supply apparatus which is capable of providing at least two sources of web material. For illustrative purposes, FIG. 1 shows two stations 50 and 51 which are capable of feeding web splicer 10 of the present invention with a first and second source of web material. Those skilled in the art, however, will recognize that stations 50 and 51 are merely illustrative of one of many possible embodiments. Further, stations 50 and 51 and pinch rollers 47 and 48 are merely illustrative and are not a part of the present invention.

As shown in FIG. 1, a first source of supply in the form of a nearly depleted roll of web material 52 having a core 53 is mounted on a spindle 54. Spindle 54 is mounted at the lower extremity of bracket-arm 55. A roller 56 is mounted at the upper extremity of bracket-arm 55. The web from roll 52 passes over roller 56, over an additional roller 57, and enters web splicer 10 by passing under feed roller 16. The web from roll 52 further passes under support 22, around guide roller 26 and extends to pinch rollers 47 and 48. The path of the web from depleting roll 52 in to the web splicer 10 and up to guide roller 26 is generally referred to as path 58. In a similar fashion, a second source of supply in the form of a spare supply roll of web material 62 having a core 63 is mounted on spindle 64. Spindle 64 is mounted at the lower extremity of bracket-arm 65 which carries a roller 66 mounted thereon at its upper extremity. The web from roll 62 passes over roller 66 and enters the web splicer 10 by passing under roller 17. The web from roll 62 further passes under support 23 and comes into contact with guide roller 27 where it is held in contact with guide roller 27 in close proximity to the web running from depleting roll 52. The path from supply roll 62 into the web splicer 10 and up to guide roller 27 is generally referred to as path 68.

The leading portion of web from supply roll 62 is generally prepared with an adhesive, such as double-face tape, to allow the leading edge from supply roll 62 to affix itself to the running web found in path 58 during a splice. As will be described in detail below, a mechanical valve allows communication between a vacuum pump (not shown) and either guide roller 26 or 27 to create a vacuum within either guide roller 26 or 27, respectively. In reference to FIG. 1, the valve allows communication between guide roller 27 and the vacuum pump (not shown) when a fresh web is fed through path 68 up to guide roller 27, thus creating a vacuum within guide roller 27 sufficient to hold the leading portion of the fresh web in path 68 against guide roller 27. The web in path 68 is held by the vacuum within guide roller 27 until the web in path 68 is spliced to the expiring web in path 58. When the splice is completed, the valve will no longer allow communication with the vacuum pump. During a splicing operation swing arm assembly 40 is rotated clockwise so that guide roller 27 is pressed together with guide roller 26 (as shown in FIG. 1) to allow the leading portion of web material from supply roll 62 to join to the trailing portion of the running web from depleting roll 52. Once a splice has been completed, the web from depleting roll 52 is severed upstream from the splice. Subsequently, the web from roll 62 will be drawn into the parent machine (not shown) through pinch rollers 47 and 48. Thereafter, core 53 of depleted roll 52 can be removed from spindle 54 so that spindle 54 may accommodate a fresh supply roll of web material.

Refer now to FIG. 2. FIG. 2 depicts the web splicer 10 of present invention from a top perspective where guard doors 32 and 33 have been removed thereby exposing cutter assembly 70. Cutter assembly 70 comprises a cutter arm 72 having a bulbous end portion 71 mounted to shaft 73 and a cutter head assembly 74 mounted at the free end of cutter arm 72. Arm 72 is mounted to pivot in response to the rotation of shaft 73 and is moveable between two cutting positions located at supports 22 and 23 to facilitate severence of the webs found in paths 58 and 68, respectively. Clockwise rotation of shaft 73 will cause cutter head assembly 74 to move toward support 22. Similarly, counter clockwise rotation of shaft 73 will cause cutter head assembly 74 to move toward support 23. It should be appreciated that shaft 73 functions as a transmission shaft of which the movement of swing arm assembly 40, cutter assembly 70 and the presence of the vacuum within guide rollers 26 and 27, as will be described in detail below, are mechanically linked to.

Figure 3:
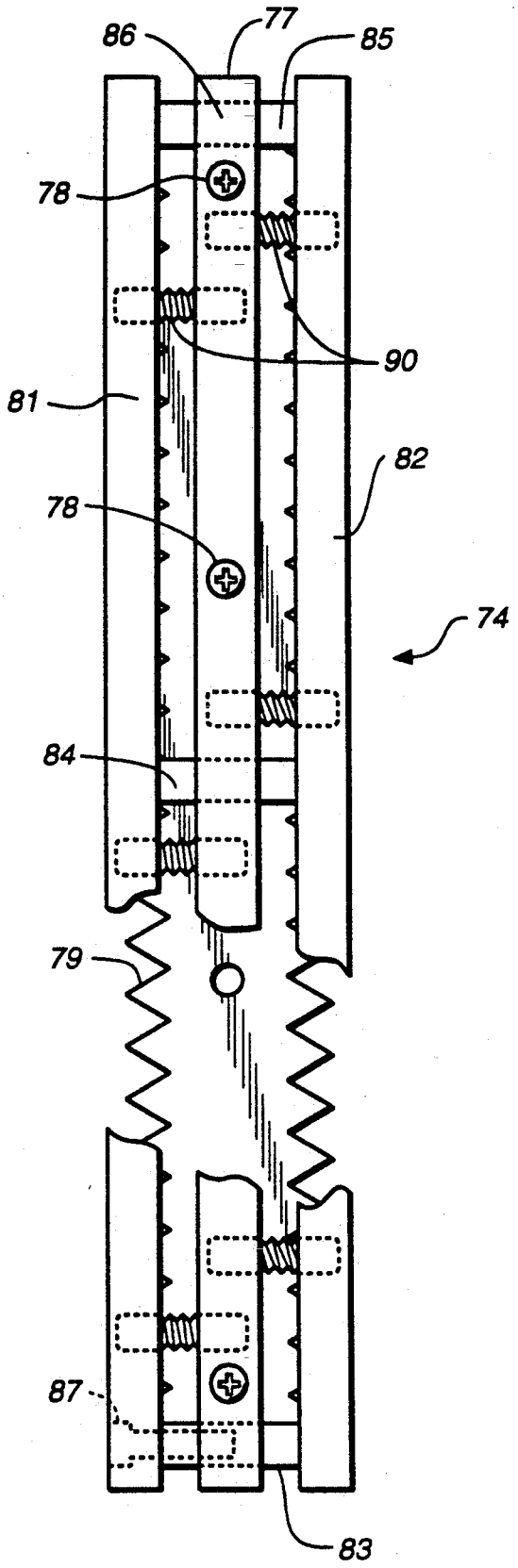
FIG. 3 is an enlarged detailed facing view of the cutter head assembly in accordance with the present invention.

Refer now again to FIG. 2 and to FIG. 3 which shows cutter head assembly 74 in greater detail. Assembly 74 comprises a primary bar 77 which is fastened to the free end of arm 72 by four screws 78. In reference to the cut-away portion of FIG. 3, it can be seen that a double-edge blade 79 is mounted to the free end of arm 72 sandwiched between the free end of arm 72 and bar 77. Screws 78 fasten both blade 79 and bar 77 to cutter arm 72. Side bars 81 and 82 are mounted to be slidingly received through the sides of bar 77 by running hollow cylinders 83, 84 and 85 (shown partially in ghost) through three circular bores 86 in bar 77. Each bore 86 being slightly larger in diameter than the outer diameter of cylinders 83, 84 and 85 so that each cylinder 83, 84 and 85 is free to slide within bar 77. Screws 87 (one screw 87 can be seen in ghost at the lower left-hand corner of FIG. 3) are fed through openings in bars 81 and 82 and are received within inner threads of cylinders 83, 84 and 85 to rigidly connect bars 81 and 82 to each other. An equal biasing force is supplied by six springs 90 to bars 81 and 82 in order to center bar 77 between bars 81 and 82.

Bars 81 and 82 form a sheath about blade 79 so that the edges of blade 79 are not normally exposed. During a cutting operation, shaft 73 will either rotate arm 72 clockwise toward support 22 or counterclockwise toward support 23. As an example, to sever the running web in path 58, transmission shaft 73 will rotate arm 72 clockwise to move cutter head assembly 74 toward support 22. When side bar 81 comes into contact with support 22 the web of path 58 will be pinned therebetween. Further rotation of shaft 73 with sufficient force to overcome the force stored within the springs 90 will allow blade 79 to move into channel 91 to sever the running web. Pinning the running web material upstream of channel 91 assures that sufficient web tension will remain on the web to facilitate severance even where the end of the web in path 58 has come loose from roll 52 at core 53. In a similar fashion, support 23 has a channel 92 for receiving blade 79 after bar 82 has pinned the web material from path 68 against support 23 to allow severance of the web in path 68.

Refer now again to FIG. 2. As described above, guide roller 27 is carried by swing arm assembly 40 mounted to pivot shaft 44. Rotation of swing arm assembly 40 is caused by rotation of cam arm 94 (shown in ghost). Cam arm 94 is mounted to pivot shaft 44 below plate 15 and serves to mechanically link the operation and motion of swing arm assembly 40 to the rotation of shaft 73.

Figure 4C:
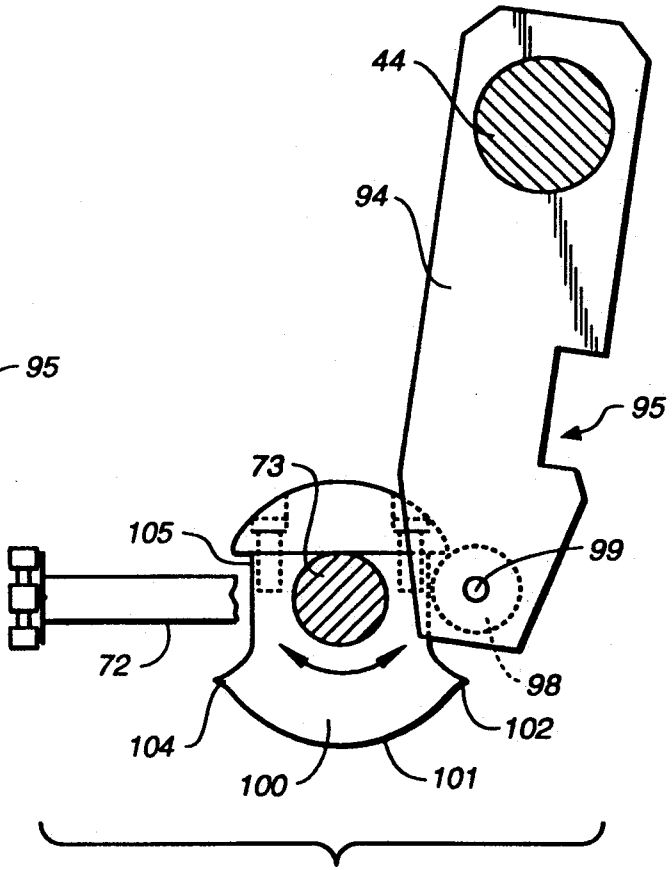
FIGS. 4(*a*)-(*c*) are enlarged illustrations taken from a top perspective which sequentially depict the coupling relationship between the main transmission shaft, the cutter assembly, and the swing arm assembly, as follows.
Figure 4B:
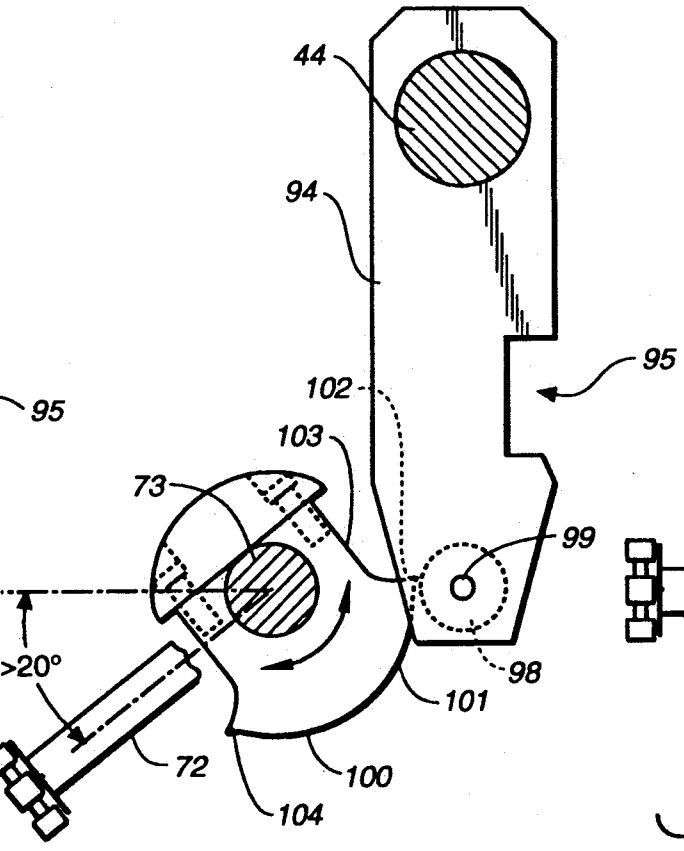
Figure 4A:
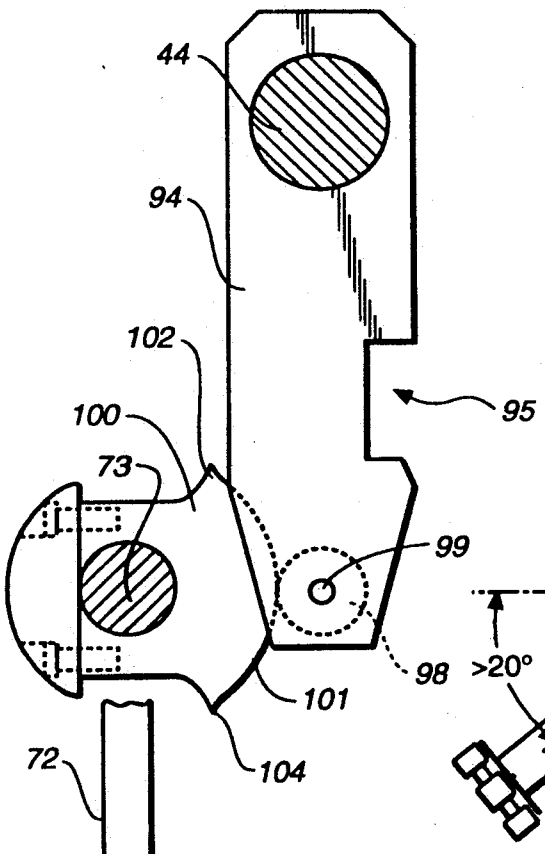

Refer now again to FIG. 2 and also to FIGS. 4(*a*)-(*c*) which show the coupling relationship between cam arm 94 and transmission shaft 73 from a top perspective where plate 15 has been removed for illustrative purposes. Cam arm 94 comprises a recess 95 for receiving a biassing spring 96. Spring 96 is held in place by spring retainer 97 which is bolted to support frame 12 as depicted in FIG. 2. Spring 96 continuously exerts a strong biassing force on cam arm 94 to urge pivot shaft 44 to rotate in a clockwise direction as viewed from the top of web splicer 10. Those skilled in the art will recognize that cam arm 94, plate 42 and plate 43 are the functional equivalent of a single rigid member. Cam arm 94, plates 42 and 43 and pivot shaft 44 may be formed as a single member within the spirit and scope of the present invention. Similarly, Cam arm 94 can be eliminated by design choice by applying the biasing force supplied by spring 96 directly to either plate 42 or 43 using an appropriate mounting bracket for spring 96 and by incorporating the functional aspects of cam arm 94 into either plate 42 or 43 within the spirit and scope of the present invention.

A standard ball-bearing cam follower 98 is attached to cam arm 94 by rod 99. Cam follower 98 is carried directly below cam arm 94. An explanation of cam follower 98 is not necessary in order to understand the present invention and enable one of ordinary skill in the art to make and use the same. Cam follower 98 is of ordinary construction and is commercially available from the Torrington Corporation as part #CRHS12. A single cam following member comprising cam arm 94 and cam follower 98 is within the spirit and scope of the present invention. Cam follower 98 is positioned to be held in contact with cam 100 at surface 101 when cutter arm 72 forms a 90° angle with the face of web splicer 10 as depicted in FIGS. 2 and 4(*a*). The strong biassing force supplied by spring 96 on cam arm 94 insures that the cam follower 98 will remain in contact with cam 100 at all times. For descriptive purposes, the positioning of cutter arm 72, cam 100, cam arm 94, swing arm assembly 40 and guide roller 27 as shown in FIGS. 2 and 4(*a*) will hereinafter be referred to as the "relaxed" or "neutral" position.

Refer now to FIG. 4(*b*). When cam arm 72 is rotated clockwise cam 100 simultaneously rotates clockwise. As cam 100 rotates cam follower 98 rides along the surface 101 of cam 100, due to the biasing force applied by spring 96 to cam arm 94, until the rotation of shaft 73 is arrested when cam follower 98 comes into contact with detent 102 as pictured in FIG. 4(*b*). Detent 102 is of a sufficient size so that an operator of web splicer 10 will feel and experience a "stop" as he or she rotates arm 72 clockwise toward support 22. For descriptive purposes, the position of cutter arm 72, cam 100 and cam arm 94 as shown in FIG. 4(*b*) will hereinafter be referred to as the left "cut-standby" position. When cutter arm 72 is rotated from the relaxed position to the left cut-standby position cam arm 94, swing arm assembly 40, and thus guide roller 27, remain stationary.

Detent 102 functions to halt the rotation of shaft 73 so that cutter arm 72 may be rotated from the neutral position to the left cut-standby position, but is prevented from accidentally striking support 22 and prematurely severing the running web of path 58. In addition, detent 102 provides a sticking point or resistance which must be overcome in order to allow cutter head assembly 74 to strike support 22. Consequently, a relatively large force must be applied to shaft 73 in order to overcome this resistance. The sudden pivot which occurs as the resistance is overcome functions to positively "slam" cutter head assembly 74 against support 22. The positive action of overcoming detent 102, in part, functions to allow web splicer 10 to splice at relatively high web speeds with very accurate registration.

When cutter arm 72 is rotated toward support 22 from the left cut-standby position depicted in FIG. 4(*b*), cam follower 98 continues to hug the irregular periphery of cam 100 and comes into contact with surface 103 as cutter head assembly 74 slams against support 22. Travel along the discontinuous pattern of cam 100 from detent 102 to surface 103 will cause cam arm 94 to abruptly pivot in a clockwise fashion to the position depicted in FIG. 4(*c*). The abrupt pivot of cam arm 94, which occurs simultaneously with the severance of the web found in path 58, rotates swing arm assembly 40 clockwise to press guide roller 27 against guide roller 26. As guide rollers 26 and 27 are pressed together the web material from supply roll 62 is joined together with the web from roll 52. Those skilled in the art will recognize that the irregular cross section provided by cam 100 may be an integral part of shaft 73 within the spirit and scope of the present invention.

In a fashion similar to that described in the preceding paragraph, detent 104 functions to halt the rotation of shaft 73 so that cutter arm 72 may be put into a right "cut-standby" position, where arm 72 is predisposed to sever the web of path 68, while preventing shaft 72 from accidentally striking support 23 and prematurely severing the web of path 68. Cam follower 98 will continue to hug the periphery of cam 100 and will come into contact with surface 105 as cutter head assembly 74 slams against support 23. Travel along the discontinuous pattern of cam 100 from detent 104 to surface 105 causes arm 94 to abruptly pivot in a clockwise fashion. The abrupt pivot of cam arm 94, which occurs simultaneously with the severance of the web found path 68, rotates swing arm assembly 40 clockwise to press guide roller 27 against guide roller 26.

Figure 5:
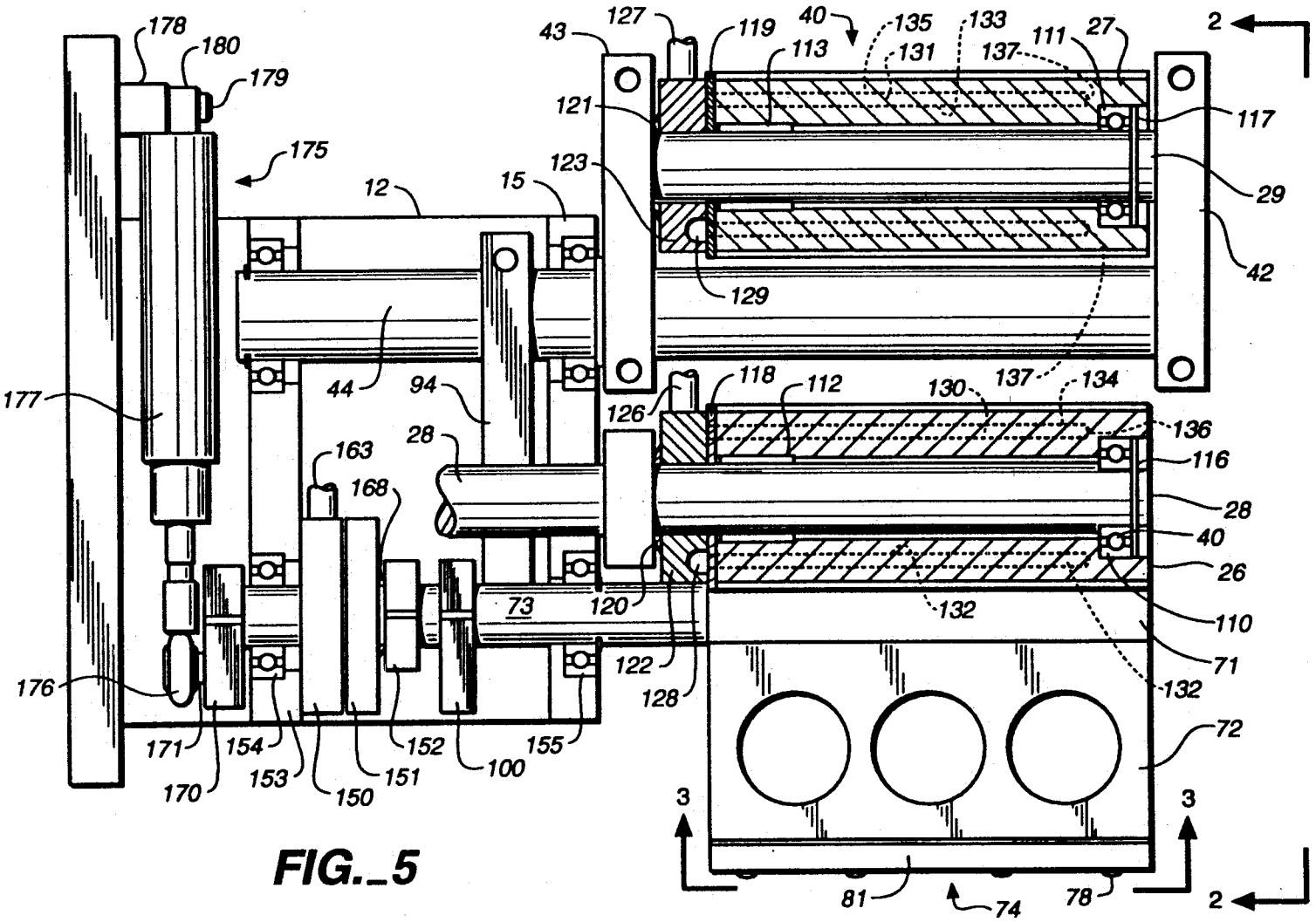
FIG. 5 is a sectional side view of the present invention.

Refer now to FIG. 5. FIG. 5 is a cross-sectional view of web splicer 10 where the cross-section comprises a plane perpendicular to plate 15 and parallel to an imaginary line drawn between pivot shaft 44 and transmission shaft 73. For illustrative purposes, pivot shaft 44 has been rotated in FIG. 5 in a counterclockwise fashion beyond its permissible range (approximately 180° beyond its permissible range) so that swing arm assembly 40 extends from the left of shaft 44. Guide rollers 26 and 27 are mounted on shafts 28 and 29 by means of bearings 110 and 111, respectively. Guide roller 26 exclusively rotates in a counterclockwise manner and guide roller 27 exclusively rotates in a clockwise manner due to the function of one way clutches 112 and 113, respectively. An explanation of one way clutches 112 and 113 is not necessary in order to understand the present invention and enable one of ordinary skill in the art to make and use the same. Clutches 112 and 113 are commercially available from the Torrington Corporation as part #RCB162117.

Retaining rings 116 and 117 encircle shafts 28 and 29 to prevent upward reciprocal movement of guide rollers 26 and 27 on shafts 28 and 29, respectively. Wear plates 118 and 119 are mounted to the bottom of guide rollers 26 and 27, respectively. A biassing force is applied to wear plates 118 and 119 by spring washers 120 and 121, respectively. The biassing force exerted by washers 120 and 121 maintain a face sealing arrangement between wear plate 118 and guide roller vacuum block 122 and also between wear plate 119 and guide roller vacuum block 123, respectively. Vacuum blocks 122 and 123 are fixed by pins (not shown) to prevent rotational movement.

Figure 6A:
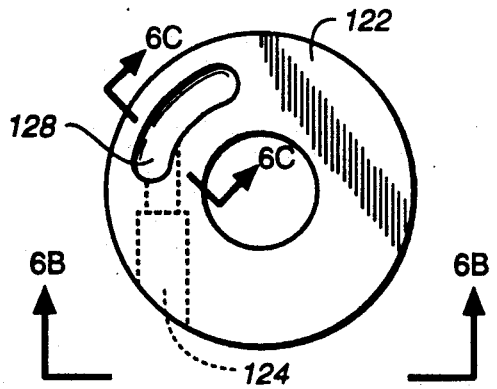
FIGS. 6(*a*)-(*c*) show three views of a guideroller vacuum block in accordance with the present invention, FIG. 6(*a*) is a top view, FIG. 6(*b*) is a facing view and FIG. 6(*c*) is a sectional view illustrating a channel therein.
Figure 7:
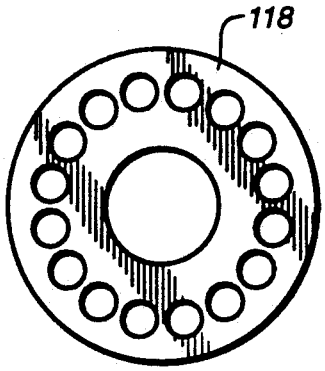
FIG. 7 is a top view of a guide roller wear plate in accordance with the present invention.
Figure 6B:
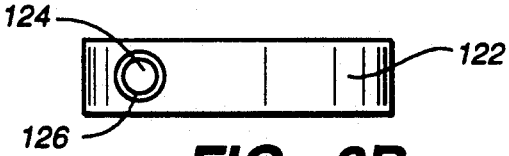
Figure 6C:
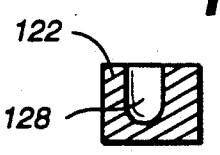

Refer now to FIGS. 6(*a*)-(*c*) and 7 and again to FIG. 5 (items shown in ghost are normally not visible to the eye). Vacuum block 122 contains a bore 124 for receiving a fitting 126. Bore 124 leads to a channel 128 which forms an arc of slightly less than 90° that is in direct communication with wear plate 118. Wear plate 118 contains a plurality of holes and is mounted on guide roller 26 so that rotation of guide roller 26 will also rotate wear plate 118. In an identical fashion, vacuum block 123 contains a bore 125 for receiving a fitting 127. Bore 125 leads to a channel 129 which forms an arc of slightly less than 90° that is in direct communication with wear plate 119. Wear plate 119 contains a plurality of holes and is mounted onto roller 27 so that wear plate 119 will rotate in unison with guide roller 27.

Refer now again to FIG. 5. Guide rollers 26 and 27 each contain cylindrical compartments 130 and 131 (shown in ghost). Cylindrical compartments 130 and 131 are formed by inner walls 132 and 133, and outer walls 134 and 135, respectively. Inner wall 132 is joined with outer wall 134 at surface 136. Similarly, inner wall 133 is joined with outer wall 135 at surface 137. Outer walls 134 and 135 are substantially porous. Further, cylindrical compartments 130 and 131 are designed to mate in a face sealing arrangement with wear plates 118 and 119, respectively, so that fittings 126 and 127 are in direct communication with the outer periphery of guide rollers 26 and 27 at quadrants 140 and 141 (depicted in FIG. 2) defined by the positional alignment of channels 128 and 129 below guide rollers 26 and 27, respectively.

Figure 8A:
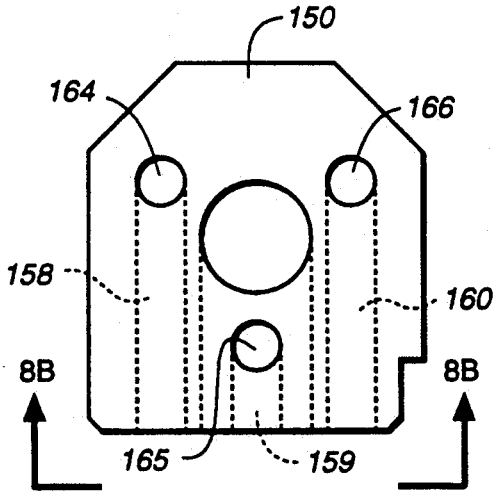
FIGS. 8(*a*)-(*b*) show two views of a vacuum block in accordance with the present invention, FIG. 8(*a*) is a top view of a vacuum block and FIG. 8(*b*) is a facing view of a vacuum block.
Figure 9A:
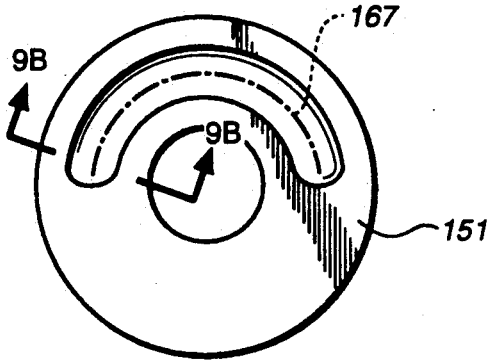
FIGS. 9(*a*)-(*b*) show two views of a rotatable vacuum block designed to interact with the vacuum block depicted in FIGS. 8(*a*)-(*b*) in accordance with the present invention, FIG. 9(*a*) is a top view of such a vacuum block and FIG. 9(*b*) is a sectional view of a portion of such a vacuum block which shows a channel formed therein.
Figure 8B:
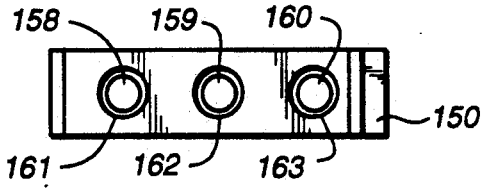
Figure 9B:
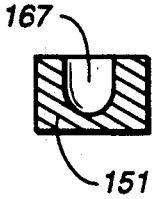

Refer now again to FIG. 5 and to FIGS. 8(*a*)-(*b*) and 9(*a*)-(*b*). As shown in FIG. 5, transmission shaft 73 is received within block 150, block 151 and split collar 152. Block 150 is mounted to middle mounting plate 153 so that shaft 73 is free to rotate within block 150 by means of bearings 154 and 155. Split collar 152 is rigidly connected to shaft 73. Split collar 152 is coupled to block 151 by pins (not shown) so that rotation of shaft 73 is accompanied by rotation of block 151 with respect to block 150. Three passages 158, 159 and 160 are bored into block 150 extending from fittings 161, 162 and 163 at the side of block 150 to openings 164, 165 and 166 at the top of block 150, respectively. A spring washer 168 encircles shaft 73 below split collar 152 to hold block 151 in a face sealing arrangement with block 150.

A valve is comprised of blocks 150 and 151. In reference to FIGS. 9(*a*)-(*b*) it can be seen that a semicircular channel 167 has been routed into the bottom of block 151 forming an arc of approximately 180° thereon. Channel 167 is of a sufficient length to facilitate communication between opening 165 of block 150 and either opening 164 or 166 of block 150 upon rotation of shaft 73. Additionally, upon rotation of shaft 73 to the relaxed position, channel 167 is positioned where communication with opening 165 is not possible. Tubing (not shown) is provided to facilitate communication between fitting 162 and a vacuum pump (not shown). Additionally, tubing is provided to facilitate communication between fitting 161 and fitting 126 and further provided to facilitate communication between fitting 163 and fitting 127, so that upon rotation of shaft 73, a vacuum can alternately be created within either guide roller 26 or guide roller 27, respectively. An explanation of the vacuum pump (not shown) is not necessary in order to understand the present invention and enable one of ordinary skill in the art to make and use the same.

Refer now again to FIG. 5. Shaft 73, at its lower extremity, is encircled by a cylinder arm 170. Cylinder arm 170 is rigidly mounted to shaft 73, or may alternately be an integral part of shaft 73, so that rotation of cylinder arm 170 positively rotates shaft 73. A rod 171 is mounted to cylinder arm 170 and extends downward for engagement with pneumatic system 175 at reciprocating shaft 176. Pneumatic system 175 comprises an air cylinder 177 rotatably mounted to post 178 by means of a mounting bolt 179 inserted through a flange 180 which is integral to air cylinder 177. Reciprocating shaft 176 is received within air cylinder 177. Air cylinder 177 is designed to either push or pull shaft 176 upon actuation. FIG. 5 depicts shaft 176 in its fully extended relaxed position corresponding to the aforementioned relaxed position where cutter arm 72 is extended perpendicular to the face of web splicer 10 as described above.

When transmission shaft 73 is rotated approximately 70° from its neutral position, either clockwise or counterclockwise, cutter arm 72 will be positioned to be predisposed to move toward support 22 or support 23, respectively, upon actuation of air cylinder 177. As an example, clockwise rotation of cutter arm 72 to the left cut-standby position, approximately 20° from support 22, will cause arm 170 to rotate out of the page of FIG. 5 and will also cause air cylinder 177 to rotate about mounting bolt 179 in a clockwise fashion. In this position, actuation of air cylinder 177 to pull shaft 176 will cause cutter head assembly 74, which is predisposed to cut the web of path 58, to move toward and slam against support 22, thereby severing the web of path 58. In a similar manner, counterclockwise rotation of cutter arm 72 to the right cut-standby position, approximately 20° from support 23, will predispose cutter arm 72 to sever the web in path 68. In this position, actuation of air cylinder 177 to pull shaft 176 will cause cutter head assembly 74, which is predisposed to cut the web of path 68, to move toward and slam against support 23, thereby severing the web of path 68. Actuation of air cylinder 177 to extend shaft 176 following a splice returns cutter arm 72 to its relaxed position and disconnects all communication with the vacuum pump (not shown) and guide rollers 26 and 27.

Figure 10:
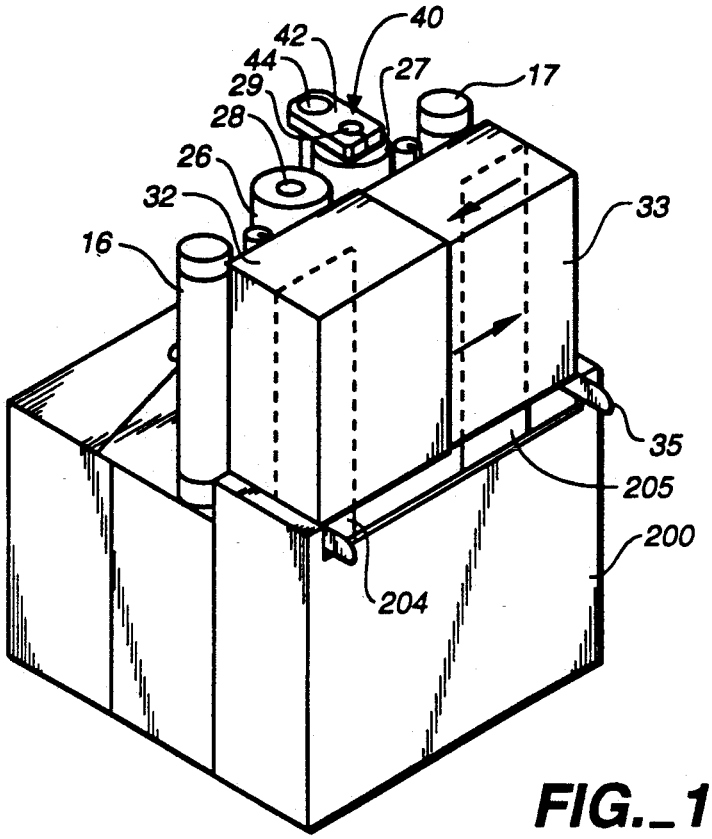
FIG. 10 is a pulled back full view of the present invention including the guard doors shown in FIG. 1.
Figure 11:
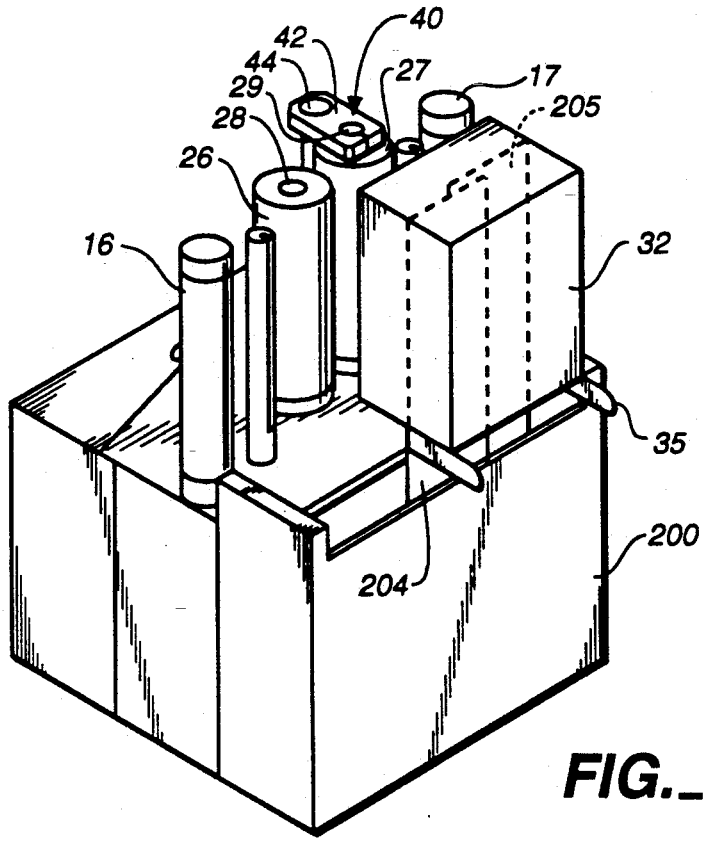
FIG. 11 is a further depiction of the view shown in FIG. 10 where the left hand guard door of the present invention has been opened.

Refer now to FIGS. 10 and 11. As described above, cutter arm 72 is normally positioned perpendicular to the face of web splicer 10. By rotating cutter arm 72 either clockwise or counterclockwise to the corresponding cut-standby position, the web splicer 10 can be predisposed to sever the running web of path of 58 or the web of path 68. Cutter arm 72 is positioned in the preferred embodiment by sliding guard doors 32 or 33 or, in an alternative embodiment, through the manual efforts of the operator. Guard doors 32 and 33 are mounted on housing stand 200, attached to support frame 12, for sliding movement within slot 203. Guard doors 32 and 33 each have a panel 204 and 205 which are mounted parallel to the face of guard doors 32 and 33, respectively, extending below the bottom of guard doors 32 and 33 into stand 200 below mounting plate 15. Guard doors 32 and 33 are mounted to slide from left to right and from right to left, respectively, so that door 32 slides on the outside of door 33. FIG. 10 depicts web splicer 10 in the neutral position described above wherein cutter arm 72 is positioned perpendicular to the face of stand 200. Further, guard doors 32 and 33 are both depicted in their closed position. When guard door 32 slides to the right, cutter arm 72 rotates counterclockwise to the right cut-standby position. More specifically, as door 32 slides to the right, panel 204 comes into contact with cutter arm 72. As door 32 continues to slide to the right, cutter arm 72 rotates to the right cut-standby position. In a similar manner, as door 33 slides from the closed position of FIG. 10 to the left, panel 205 will come into contact with cutter arm 72. Further motion of guard door 33 will cause cutter arm 72 to move into the left cut-standby position.

Figure 12:
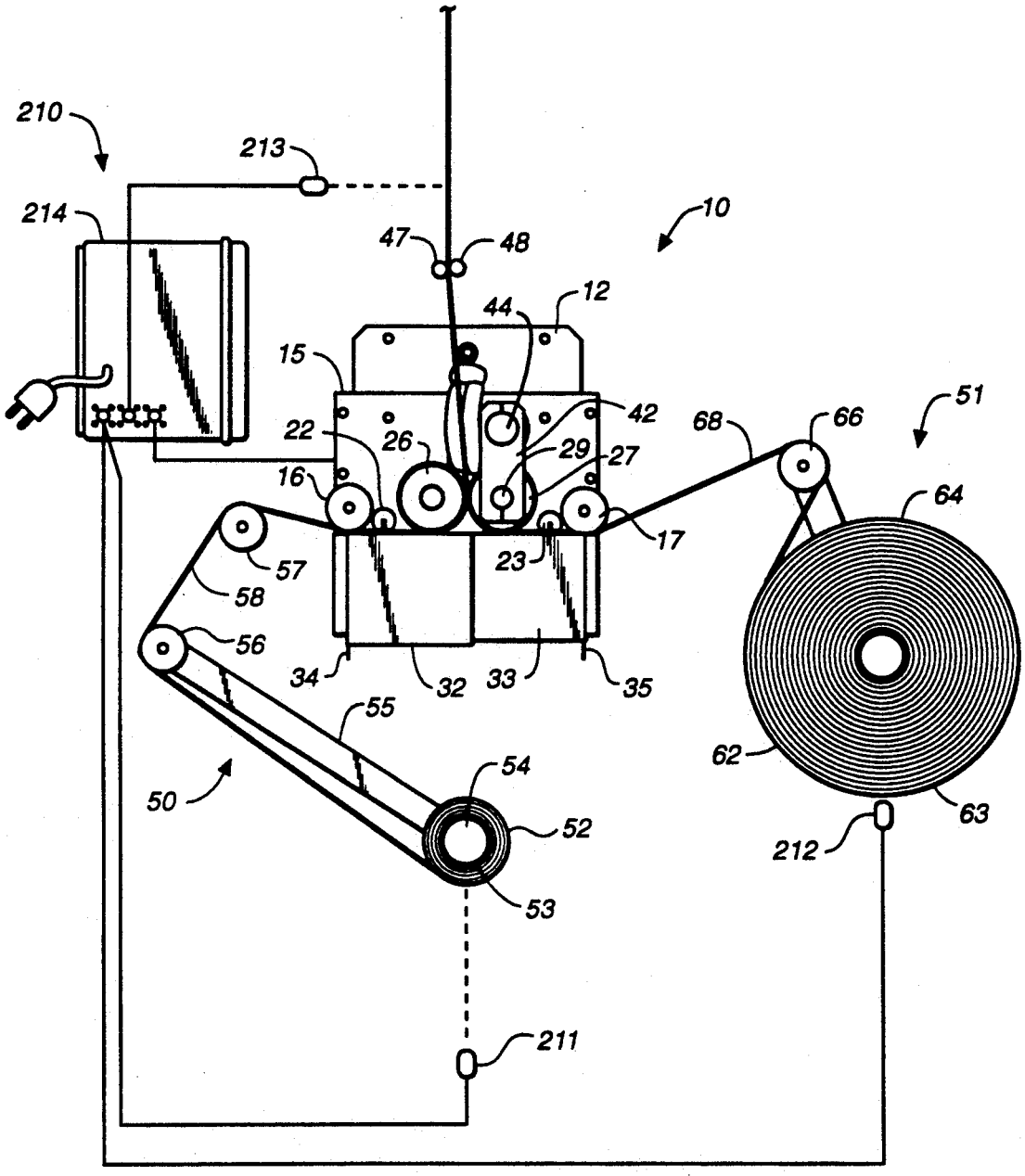
FIG. 12 is a depiction of the apparatus shown in FIG. 1 further including sensing apparatus.

Refer now to FIG. 12. Web splicer 10 of the present invention is depicted with associated electronic control means 210. Control means 210 comprises low roll sensors 211 and 212, a registration verification sensor 213 and a control box 214. Sensors 211 and 212 function to provide control box 214 with signals indicating that either roll 52 or roll 62, respectively, is about to expire. If the web has a design printed thereon sensor 213 is employed to time the splicing operation so that the printed design of the spliced web is in registration. A detailed explanation of control means 210 is not necessary in order to understand the present invention and enable one of ordinary skill in the art to make and use the same.

As heretofore explained, it is desired to splice the spare supply web material present in web path 68 to the running web found in path 58. Having described the present invention in detail hereinabove, the procedure utilized for web splicing will now be described.

When as shown in FIG. 2, the web splicer 10 is in a "neutral" position following a splice, the running web found in path 58 is being fed to pinch rollers 47 and 48. Path 68 is empty and ready to accept a fresh source of web material. Cutter arm 72 is fully extended in the neutral position and guide rollers 26 and 27 are spaced apart following the completion of a splice. As the web in path 58 continues to run, a fresh supply roll 62 is placed on spindle 64. In reference to FIG. 10, to feed the leading portion of the web from roll 62 through path 68 up to guide roller 27, the user slides guard door 33 to the left to gain access to guide roller 27. As door 33 slides to the left, panel 205 comes into contact with cutter arm 72 causing arm 72 to pivot clockwise toward the left cut-standby position represented in ghost at FIG. 2. In reference to FIGS. 4(*a*)-(*c*) and FIG. 5, clockwise rotation of cutter arm 72 caused by panel 205 causes simultaneous clockwise rotation of shaft 73. Cam follower 98 likewise simultaneously follows the irregular periphery of cam 100 at surface 101 as transmission shaft 73 rotates until the cut-standby position is reached at detent 102, where all rotation is halted. Panel 205 is positioned within guard door 33 so that cutter arm 72 is rotated out of contact with panel 205 as the cut-standby position is achieved thereby allowing further travel of door 33 in track 203 without disturbing arm 72.

In reference to FIGS. 5 through 9, as shaft 73 rotates clockwise to the left cut-standby position as described hereinabove, block 151 simultaneously rotates with respect to block 150 thereby rotating channel 167 into a position where opening 165 is in direct communication with opening 166. The vacuum pump (not shown) applied to passage 159 at fitting 162 is put into direct communication with guide roller 27 by passing through block 150 under the direction of channel 167, through tubing (not shown) to vacuum block 123, through channel 129, wear plate 119 and cylindrical compartment 131. The vacuum is communicated to approximately 25% of the outer periphery of guide roller 27 at quadrant 141 which is positioned directly above channel 129 as shown in FIG. 2.

The web from fresh supply roll 62 next is manually fed through path 68 up to guide roller 27 where the vacuum created therein grips the leading portion of the web material at quadrant 141 and thereby holds the web in contact with guide roller 27. Guide roller 27 is prevented from rotating counterclockwise due to the operation of one-way clutch 113. As the web from path 68 is held in place, an adhesive material, such as double-face tape, is applied to the leading end of the web. It can be appreciated that by simply "opening" the right-hand guard door 33, the web splicer 10 has been put into the left cut-standby position whereby cutter arm 72 is predisposed to sever the running web found in path 68 and where a vacuum has been created within guide roller 27 to hold the leading portion of the supply web found in path 68 in contact with guide roller 27 and in close proximity to the running web found in path 58. It is generally desirable to close door 33 once the leading portion of the web found in path 68 is held in place at roller 27. At all times, the entire cutter assembly has been enclosed by guard doors 32 and 33 to protect the user. However, in an alternate embodiment, guard doors 32 and 33 and stand 200 are removed from the preferred embodiment of the present invention, thereby requiring the operator to manually rotate cutter arm 72 to the left cut-standby position.

In reference to FIG. 5, as cutter arm 72 rotates to the left cut-standby position, cylinder arm 170 rotates out of the page of FIG. 5 so that, upon activation, air cylinder 177 will cause cutter arm 72 to move toward and strike support 22.

In reference to FIG. 12, sensor 211 detects when roll 52 is substantially depleted. When roll 52 is substantially depleted sensor 211 sends a signal to control box 214. Registration verification sensor 213 sends timing signals to control box 214 to enable control box 214 to send an appropriate actuation signal to web splicer 10 to ensure proper and precise registration. The signal provided by control box 214 actuates air cylinder 177, causing air cylinder 177 to pull on reciprocating shaft 176, subjecting cylinder arm 170 to a sudden pulling force. The pulling force is initially counteracted by the resistance produced by cam follower 98 resting at detent 102 of cam 100. The initial resistance is overcome with sufficient force supplied by air cylinder 177 causing an abrupt and violent pivot of cutter arm 72 clockwise toward support 22. In a near instantaneous motion, cutter assembly 74 strikes support 22. In reference to FIG. 3, the running web in path 58 is pinned between side bar 81 and support 22 as cutter arm 72 compresses the left-hand trio of springs 90 allowing blade 71 into channel 91 of support 22 thereby severing the running web found in path 58.

In reference to FIGS. 4(*a*)–(*c*) and FIG. 5, as cutter arm 72 abruptly pivots clockwise from the left cut-standby position shown in FIG. 4(*b*), cam arm 94 simultaneously abruptly pivots in a clockwise manner to press guide roller 27 together with guide roller 26. Guide rollers 26 and 27 are shown pressed together in FIG. 1. By pressing guide rollers 26 and 27 together, the double-face tape applied to the leading portion of the web material being held by guide roller 27 will cause the two webs to be joined together between guide rollers 26 and 27.

The step of severing the pinned running web of path 58 and the step of joining the two webs between guide rollers 26 and 27 occur simultaneously. Each step is mechanically dependant upon the rotation of shaft 73 so that any need for timing between the two steps is eliminated. It should be appreciated that a single pull from air cylinder 177, sufficient to overcome the resistance mentioned above, acts to violently and abruptly slam cutter arm 72 against support 22 and to literally slam guide roller 27 against guide roller 26 due to the large biasing force supplied by spring 96. In the left cut-standby position, cutter head assembly 74 is typically located less than 20° from support 22 and guide roller 27 is in very close proximity to guide roller 26, so that a splice can be made nearly instantaneously upon actuation of air cylinder 177. This combination of force, speed, short travel and simplicity assures accurate splices, in registration, at high web speeds. After the web in path 68 has been severed, the strength of the splice is sufficient to survive the sudden tension applied to the web in path 58.

At the completion of the splice, air cylinder 177 is actuated to push reciprocating shaft 176 to return cutter arm 72 to its neutral position. As shaft 73 is rotated to its neutral position, channel 167 rotates counterclockwise on block 150 to disconnect the vacuum applied to guide roller 27.

While various elements of the device have been disclosed as manually activated, the elements would preferably be activated by a suitable automatic control mechanism. Conversely, during operation it may be advantageous or desirable to override automatic elements. For example, it may be desirable to be able to actuate a splice manually, independent of the low roll sensors 211 and 212. It is intended that both automatic and manual variations discussed herein be included within the spirit and scope of the present invention.

There has been shown and described a novel device for splicing web material in a web splicing apparatus which fulfills all of the objects and advantages sought therefore. Many changes, modifications, variations and other uses and applications of the subject invention will, however, become apparent to those skilled in the art after considering this application and the accompanying drawings which disclose the preferred embodiment thereof. All such changes, modifications, variations and other uses and applications which do not depart from the spirit and scope of the invention are deemed to be covered by the invention which is limited only by the claims that follow.

What is claimed is:

1. A web splicer for splicing the leading portion of web material from a fresh supply roll to the trailing portion of web material moving from an expiring supply roll to a takeup system, comprising:

first and second guide rollers normally positioned apart from each other;

holding means for gripping the leading portion of the fresh web so that the leading portion of the fresh web is held in contact with one of said first and second guide rollers;

joining means to press said first and second guide rollers together so that the leading portion of web material from the fresh supply roll can be joined by adhesive means to the trailing portion of web material moving from the expiring supply roll;

severing means for cutting the web material from the expiring supply roll moveable between a first cutting position upstream from said first guide roller and a second cutting position upstream from said second guide roller, respectively; and transmission means mechanically linked to said holding means, said joining means and said severing means operative to actuate the respective functions of said holding means, said joining means and said severing means in a predetermined sequence.

2. Apparatus according to claim 1 wherein said transmission means comprises a transmission shaft member mounted for rotational movement.

3. Apparatus according to claim 2 wherein said holding means comprises a vacuum pump in communication with a valve means, said valve means responsive to rotational movement of said transmission shaft member for alternately creating a vacuum in said first and second guide rollers.

4. Apparatus according to claim 3 wherein said valve means comprises:

a first portion having at least one passage therein adapted for connection to a vacuum pump; and a second portion mounted on said transmission shaft member, comprising a communication channel therein for alternately causing communication between said vacuum pump and at least one of said first and said second guide rollers in response to rotation of said transmission shaft member.

5. Apparatus according to claim 2 wherein said joining means comprises rotatable swing arm means having a pivot axis at one end and having one of said first and second guide rollers carried at the free end thereof and means for rotating said swing arm means so that said first and second guide rollers can be pressed together.

6. Apparatus according to claim 5 wherein said means for rotating said swing arm means comprises a cam following member having a pivot axis at one end coupled to said swing arm means and a free end responsive to the rotational movement of said transmission shaft member so that rotation of said transmission shaft member will cause said swing arm to rotate.

7. Apparatus according to claim 6 further comprising biasing means for biasing said cam following member against said transmission member, said cam following member being normally biased against said transmission shaft member at a prescribed location, said prescribed location having an irregular cross-section so that rotation of said transmission shaft member will cause said cam following member to rotate.

8. Apparatus according to claim 7 wherein said biasing means comprises a spring assembly.

9. Apparatus according to claim 8 wherein said irregular cross-section comprises a cam member mounted at said prescribed location.

10. Apparatus according to claim 2 further comprising means for positioning said severing means so that said severing means will be predisposed to sever the web material moving from the expiring supply role.

11. Apparatus according to claim 10 wherein said means for positioning said severing means comprises moveable housing means to engage and position said severing means.

12. Apparatus according to claim 11 wherein said moveable housing means comprises at least one sliding door.

13. Apparatus according to claim 10 further comprising means for rotating said transmission shaft member to actuate said predisposed severing means.

14. Apparatus according to claim 13 wherein said means for rotating said transmission shaft member comprises a pneumatic cylinder.

15. Apparatus according to claim 13 further comprising control means to delay actuation of said predisposed severing means until a predetermined mark on the web material moving from the expiring supply roll is detected.

16. Apparatus according to claim 1 wherein said severing means comprises:

a first and second support means, said first support means disposed intermediate said first guide roller and the expiring supply roll, said second support means disposed intermediate said second guide roller and the fresh supply roll; and an arm mounted for rotational movement having a pivot axis at one end and a cutting means mounted at the free end thereof, said arm being positioned so that said cutting means may alternately engage one of said first and said second support means.

17. Apparatus according to claim 16 wherein said cutting means comprises opposing first and second sharpened blade edges and first and second spring biased sheath members disposed in combination, respectively, upon the free end of said arm, each said blade edge being normally substantially concealed by one of said first and said second sheath members.

18. Apparatus according to claim 1 further comprising control means to delay splicing of the leading portion of web material from a fresh supply roll to the trailing portion of web material moving from an expiring supply roll until a predetermined mark on the web material moving from the expiring supply roll is detected.

19. A web splicer for splicing the leading portion of web material from a fresh supply roll prepared with an adhesive to the trailing portion of web material moving from an expiring supply roll to a takeup system, comprising:

first and second vacuum guide rollers normally positioned apart from each other;

a vacuum pump and pivotal valve means, said pivotal valve means in communication with said vacuum pump for alternately causing communication between said vacuum pump and one of said first and second guide rollers;

cam following means and a cam member, said cam following means responsive to said cam member to press said first and second vacuum guide rollers together so that the leading portion of web material from the fresh supply roll can be joined to the trailing portion of web material moving from the expiring supply roll; and pivotal cutting means moveable between a first cutting position and a second cutting position to cut the web material moving from the expiring supply roll.

20. Apparatus according to claim 19 further comprising mechanical drive means mechanically coupled to, for controlling the operation of, said pivotal valve means, said cam following means and said pivotal cutting means.

21. Apparatus according to claim 20 wherein said mechanical drive means comprises a rotational shaft.

22. An apparatus for alternately splicing a leading portion of web material from a first or second source of supply to web material being drawn from a second or first source of supply, respectively, comprising:

vacuum means for holding the leading portion of web material from the first or second source of supply proximate the web material being drawn from the second or first source of supply, respectively;

severing means for alternately cutting the web material being drawn from the second or first source of supply, respectively;

means for pressing the leading portion of web material from the first or second source of supply to the web material being drawn from the second or first source of supply, respectively; and moveable housing means for positioning said severing means to alternately cut one of the first and second webs.

23. Apparatus according to claim 22 wherein said moveable housing means comprises at least one sliding door.

* * * * *

UNITED STATES PATENT AND TRADEMARK OFFICE

CERTIFICATE OF CORRECTION

PATENT NO. : 5,252,170

DATED : October 12, 1993

INVENTOR(S) : R. Schaupp

It is certified that error appears in the above-identified patent and that said Letters Patent is hereby corrected as shown below:

Column 4, line 19, after "therein", insert --;--.

Column 6, line 16, after "of", insert --the--.

Column 7, line 32, delete "Cam", and insert therefor --cam--.

Column 11, line 1, after "path", delete --of--.

Signed and Sealed this

Ninth Day of May, 1995

Bruce Lehman

*Attest:*

BRUCE LEHMAN

*Attesting Officer*

*Commissioner of Patents and Trademarks*